US006098383A

United States Patent [19]

Napier

[11] Patent Number: 6,098,383

[45] Date of Patent: Aug. 8, 2000

[54] EQUESTRIAN EQUIPMENT OR THE LIKE

[76] Inventor: Mark Napier, 58 Annibale Preca Street, Lija BZN 10, Malta

[21] Appl. No.: 09/121,839

[22] Filed: Jul. 24, 1998

[30] Foreign Application Priority Data

Jul. 25, 1997 [GB] United Kingdom ..... 9715612

[51] Int. Cl.[7] ..... B68C 1/14

[52] U.S. Cl. ..... 54/23

[58] Field of Search ..... 54/23, 35; 24/197, 24/198, 200

[56] References Cited

U.S. PATENT DOCUMENTS

| | | | |
|---|---|---|---|
| 1,074,498 | 9/1913 | Eiker | 2/315 |
| 1,252,987 | 1/1918 | Armstrong | 24/198 X |
| 2,239,764 | 4/1941 | Vordemberge | 54/23 |
| 4,482,319 | 11/1984 | Patch | 433/39 |

*Primary Examiner*—Robert P. Swiatek

*Attorney, Agent, or Firm*—Pillsbury Madison & Sutro LLP

[57] ABSTRACT

Each end of a main girth strap length has a billet strap attached thereto by a fitting/component. The billet strap is threaded through the fitting/component at right angles to the main girth strap length prior to folding the ends parallel to the main girth strap length.

18 Claims, 5 Drawing Sheets

EQUESTRIAN EQUIPMENT OR THE LIKE

This invention relates to improvements in or relating to equestrian equipment or the like and is more particularly concerned with an animal girth strap.

Traditionally, girth straps may include two buckle straps attached onto each end of the main girth strap length, directly to the girth webbing and extending parallel to one another along the axis of the girth strap. However, another type of girth strap known as the "humane" girth has been in existence for some years and the buckle straps are not attached directly to the girth webbing but rather are attached to the main girth strap length via an intermediate fitting/component known as the humane girth "Dee". The humane girth strap may have certain advantages over and above traditional girth straps since the inclusion of the girth Dee on each end of the main girth strap length for the buckle straps effectively enables the buckle straps to compensate each other thereby equalling the load on each strap at each end of the girth. Even so, it is believed that both the traditional girth strap and the humane girth strap have certain disadvantages. For example, the humane girth Dee is attached onto the main girth webbing at one end of the main girth strap length normally in the centre thereof and has a tendency to cause certain problems in creasing of the girth webbing itself. Furthermore, the attachment of the buckle straps onto the girth Dee does not allow said straps to be easily removed (and would require stitching to be undone) from the main girth strap length for example, for washing and/or replacement with new buckle straps if unduly worn. Additionally, the anchorage of the buckle straps onto the webbing of the girth strap may not be optimised in the humane girth and thus may be improved in an alternative design.

Of course other designs of girth strap are known which may have one strap, two straps or three straps. In particular, reference is made to GB Patent Specification No. 2166035 which shows a main girth strap length having two billet straps at each end, each strap being removably fixed separately to an associated co-operating buckle ring fitting attached by webbing to the main girth strap length. However, since the billet straps are attached independently to the main girth strap length (albeit removably) the load cannot be compensated equally between the billet straps at the associated end of the main girth strap length. The load can be spread over substantially the whole width of the girth webbing in a similar manner provided for by the humane girth Dee. A very significant advantage in compensating the load equally between the billet straps is that if a hole (for engaging the tongue of a buckle) in one of the saddle girth straps is damaged (there are usually three such saddle girth straps on each side of the saddle) an immediately adjacent hole can be utilised instead without incurring problems.

An object of the present invention is to provide a girth strap which at least alleviates one or more of the aforementioned, or other, disadvantages in girth strap design and/or which is improved in at least some respect.

According to the present invention there is provided a girth strap comprising a main girth strap length having at least one fitting or component at an associated end thereof for a billet strap, the arrangement being that the billet strap can be removably attached to said billet/component and folded so that free buckled ends of the billet strap can extend parallel to one another along the axis of the main girth strap length.

Usually, each end of the main girth strap length will be provided with a fitting/component for an associated billet strap allowing said billet strap to be removably attached to the associated fitting/component and folded so the buckled ends can extend parallel to one another along said axis (each pair of buckled ends extending in opposed directions).

In one embodiment of the present invention, the billet strap can be threaded or passed through the fitting or component (usually generally at right angles to the main girth strap length) and each buckled end of the billet strap can be folded about a respective guide edge of the fitting/component to lie parallel along the axis of the main girth length. Usually, the fitting or component will be of rigid material such as plastics or metal and will usually have two openings joined by a bridge piece preferably extending axially of the main girth strap length. Thus, the billet strap may be introducable into the first opening and fed underneath the bridge piece and up through the second opening such that the billet strap can extend equal amounts on each side of the girth strap prior to folding. Preferably, each of the openings is similar, being mirror images of one another about the axis of the main girth strap length. One of said guide edges may be provided by an inclined edge of one of the openings and the other said guide edge may be provided by an inclined edge of the other opening. The inclined guide edges will usually extend at right angles (±10°) to one another and, preferably, at 45°±5° to the axis of the main girth strap length sloping away from the associated end of the main girth strap length towards the axis of said main girth length. A second edge of each opening opposing said guide edge will usually extend transverse of the main girth strap length.

The fitting/component will usually be of generally rectangular form secured to the girth strap length by loops of webbing. Thus the component/fitting may provide innermost transverse bar portions (defined in part by said second edges of said openings opposed to said guide edges where applicable) that can be secured to the main girth strap length by said loops of webbing stitched to said main girth strap length.

It is possible that the billet strap could be additionally secured to said fitting/component e.g. by stitching but this will usually not be necessary.

It is an advantage of embodiments of the present invention that uneven loading can be compensated for.

Further according to the present invention there is provided a fitting or component (usually substantially rigid) comprising two openings, said fitting/component being provided with means for attachment to a main girth strap length of a girth strap, for example by loops of webbing being stitched to said main girth strap length, the arrangement being such that a billet strap can be threaded through the fitting/component through said openings in a direction generally at right angles to said main girth strap length and folded twice relative thereto about a guide edge on each opening to removably attach the billet strap to the fitting/component with buckled ends of the billet strap extending parallel to one another along the axis of the main girth length.

Still further according to the present invention there is provided a girth strap having one or more of the following features:

(a) a fitting or component allowing a billet strap to be threaded therethrough generally at right angles to a main girth strap length, (b) a component or fitting having guide edges on respective openings extending generally at 90°±10° thereto and preferably generally at 45°±5° to the axis of the girth strap, (c) a billet strap removably attached to a fitting or component attached by webbing to a main girth strap length, preferably, such that buckled ends of the billet strap can be folded to extend parallel with the axis of the main girth strap length, (d) at least one generally rectangular fitting or component for a billet strap located at an associated end of a main girth strap length, said fitting or component including two similar openings being mirror images of one another about the axis of the main girth strap length, (e) a fitting or component having a guide edge for guiding the direction on which an end of a billet strap will lie.

Further advantages of the girth strap and/or a fitting/component of the present invention will be evident from the following description and drawings.

An embodiment of a girth strap in accordance with the present invention will now be described, by way of example only, with reference to the following, much simplified or schematic drawings in which.

Figure 1:
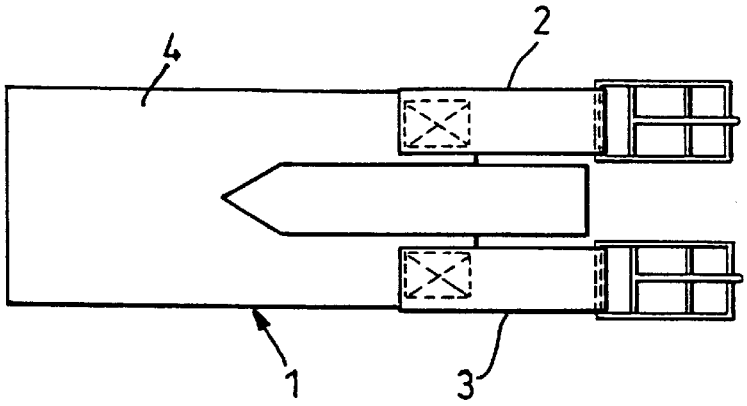
FIG. 1 illustrates one end of a traditional girth strap.

FIG. 1 shows a diagrammatic view of one end of a traditional girth strap 1 (the other end is similar) having two parallel buckle straps 2,3 attached directly to the webbing of main girth strap length 4. A disadvantage with this type of girth strap 1 is that the buckle straps cannot be removed easily for washing or replacement (stitching would have to be undone). Also, a different size (length) of buckle strap 2,3 could not be easily fitted on to the main girth strap length 4 in order e.g. to lengthen the girth strap 1 to cater for a larger animal. Additionally, there could be uneven loading on the buckle straps 2,3 when the girth strap 1 is fitted on to an animal such as a horse.

Figure 2:
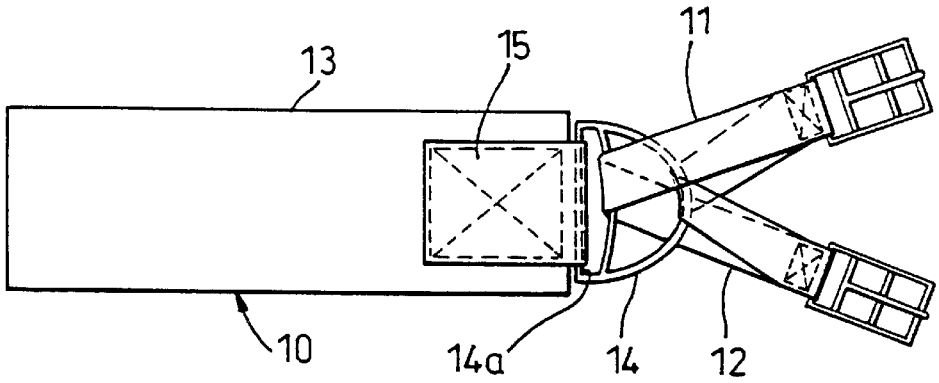
FIG. 2 shows one end of a humane girth strap.
Figure 3:
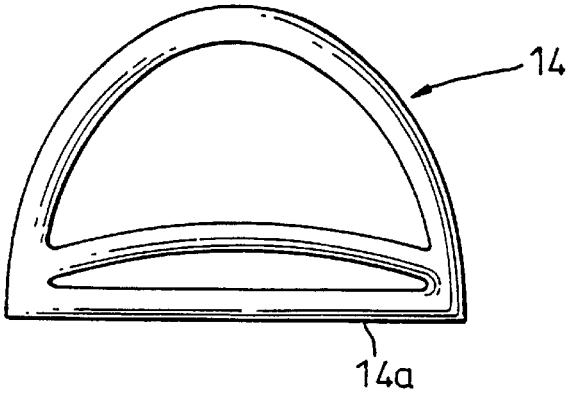
FIG. 3 shows, to a larger scale, a humane girth Dee of the strap shown in FIG. 2 drawn to a larger scale.

FIG. 2 shows schematically, one end of a girth strap 10 (the other end is similar) including buckle straps 11 and 12 effectively connected together to form one billet strap (with a buckle at either end) attached on to the end of the main girth strap length 13 by a humane girth Dee 14 (see FIG. 3) by means of webbing 15 secured around straight portion 14*a* of the Dee.

Figure 4:
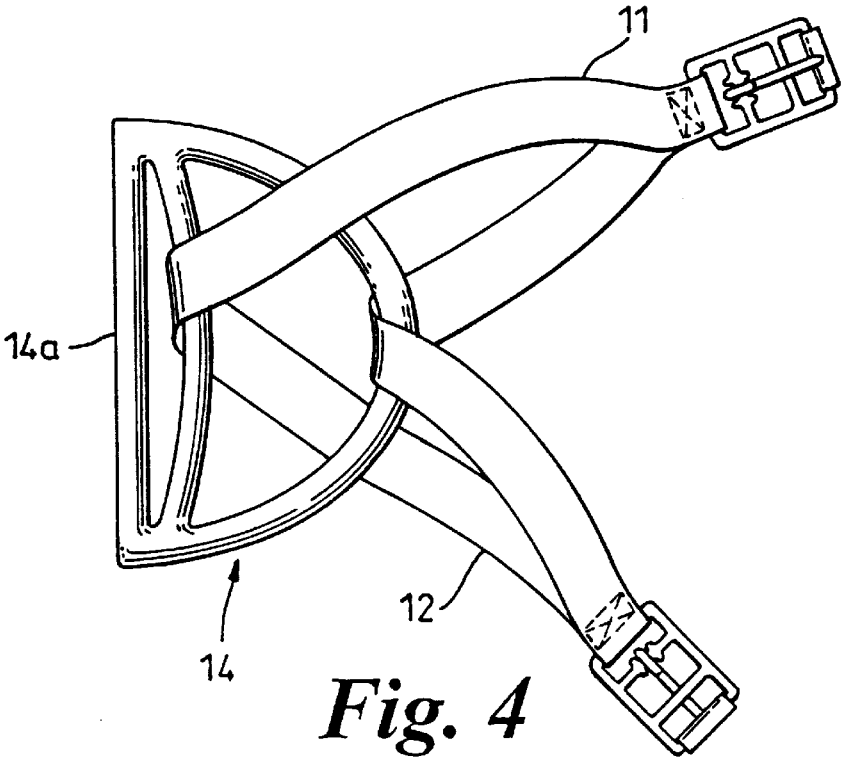
FIG. 4 illustrates how a billet strap is attached to the girth Dee.

FIG. 4 shows diagrammatically how the billet strap 11,12 is attached to the girth Dee and stitched thereto so that a new billet strap can only be fitted by cutting off the old billet strap 11,12 (or undoing stitching); thus the billet strap could not be removed for washing or the like.

One advantage of the humane girth over and above the traditional design of girth strap is that the buckle strap 11,12 compensate each other in order to equalise the load on both buckle straps. Nevertheless, certain problems may be caused in creasing of the girth webbing itself.

Figure 5:
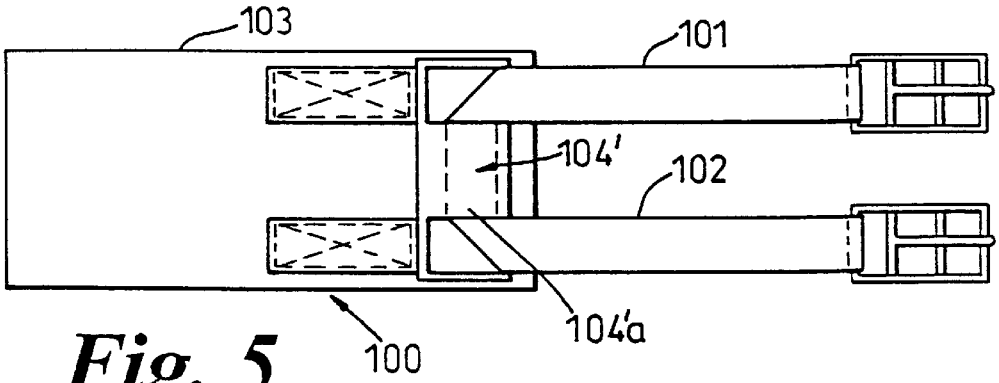
FIG. 5 shows schematically one end of a girth strap in accordance with the present invention.
Figure 6:
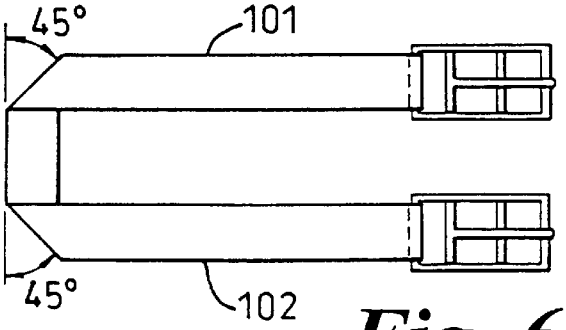
FIG. 6 shows a view similar to FIG. 5 but just of a billet strap with a main girth length of the girth strap removed.
Figure 7:
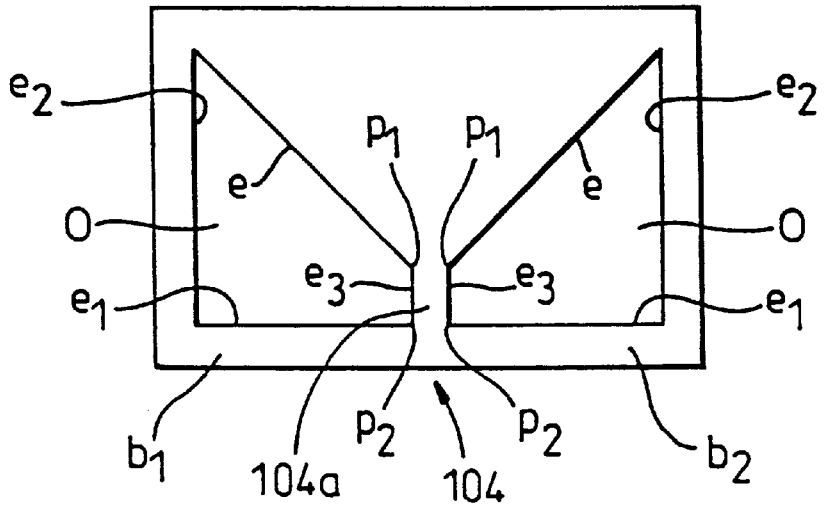
FIG. 7 shows, to a larger scale, a fitting or component which is, in use, attached to an end of the main girth length in order to attach the billet strap on to said end.

FIG. 5 shows schematically a view of an end of a girth strap 100 (the other end is similar) in accordance with the present invention. Buckle straps 101 and 102, on main girth strap length 103, are integrally connected together to form a billet strap which can be threaded through fitting/component 104 and folded twice at 45° in order to provide two buckle strap ends extending parallel to one another along the axis of said main girth strap length. The billet strap 101,102 is threaded through fitting 104' which is of the same general type as the fitting 104 shown in FIG. 7. The fitting 104' has a wider bridge piece 104'*a* than the bridge piece 104*a* shown in FIG. 7 and it is to be appreciated that the width of this bridge piece can be varied to suit, depending upon the width that the buckle straps 101,102 are to be set apart whilst extending along the main girth length.

Figure 8:
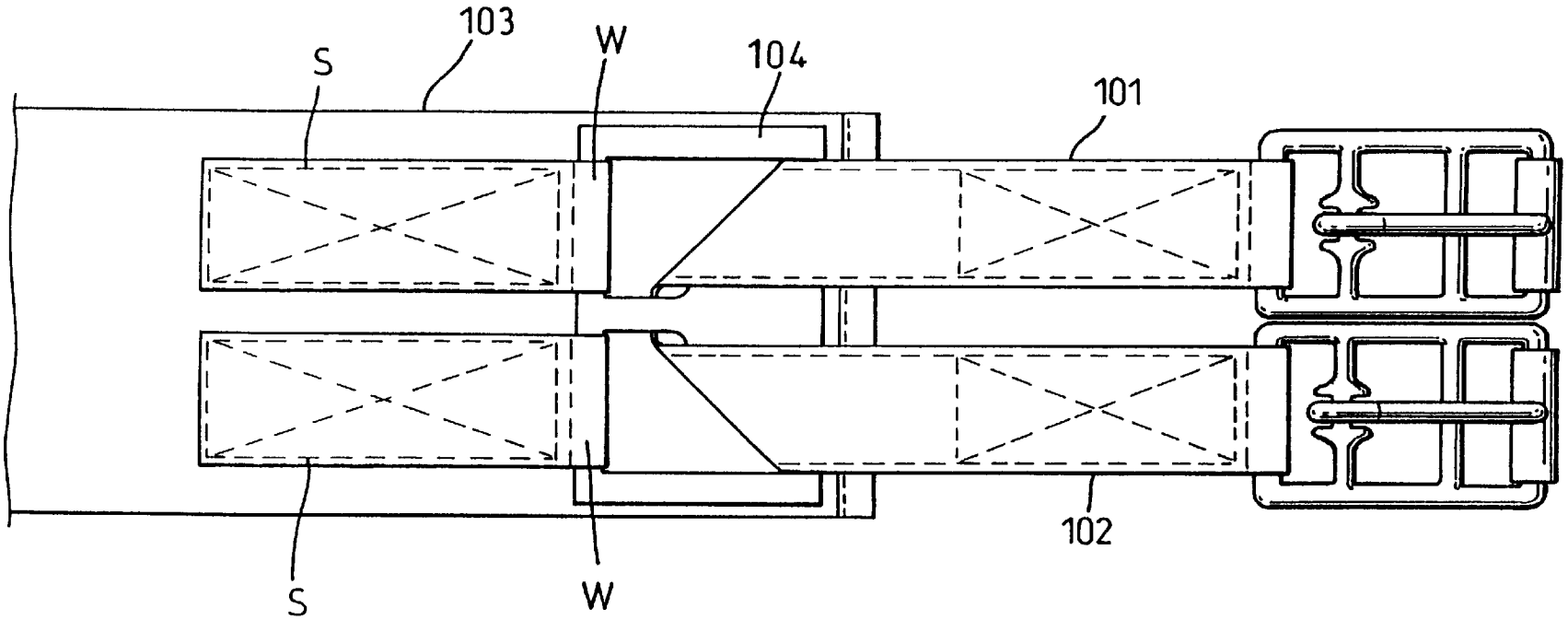
FIG. 8 shows an end of the girth strap in accordance with the present invention in greater detail than the FIG. 5 view.

FIG. 8 which shows in greater detail one end of the girth strap 103 in which the billet strap 101,102 is attached to the end of the main girth strap length 103 by means of the fitting 104 rather than the fitting 104'. Thus, the buckle straps 101,102 are shown spaced closer to one another than in the diagrammatic view of FIG. 5.

Figure 9:
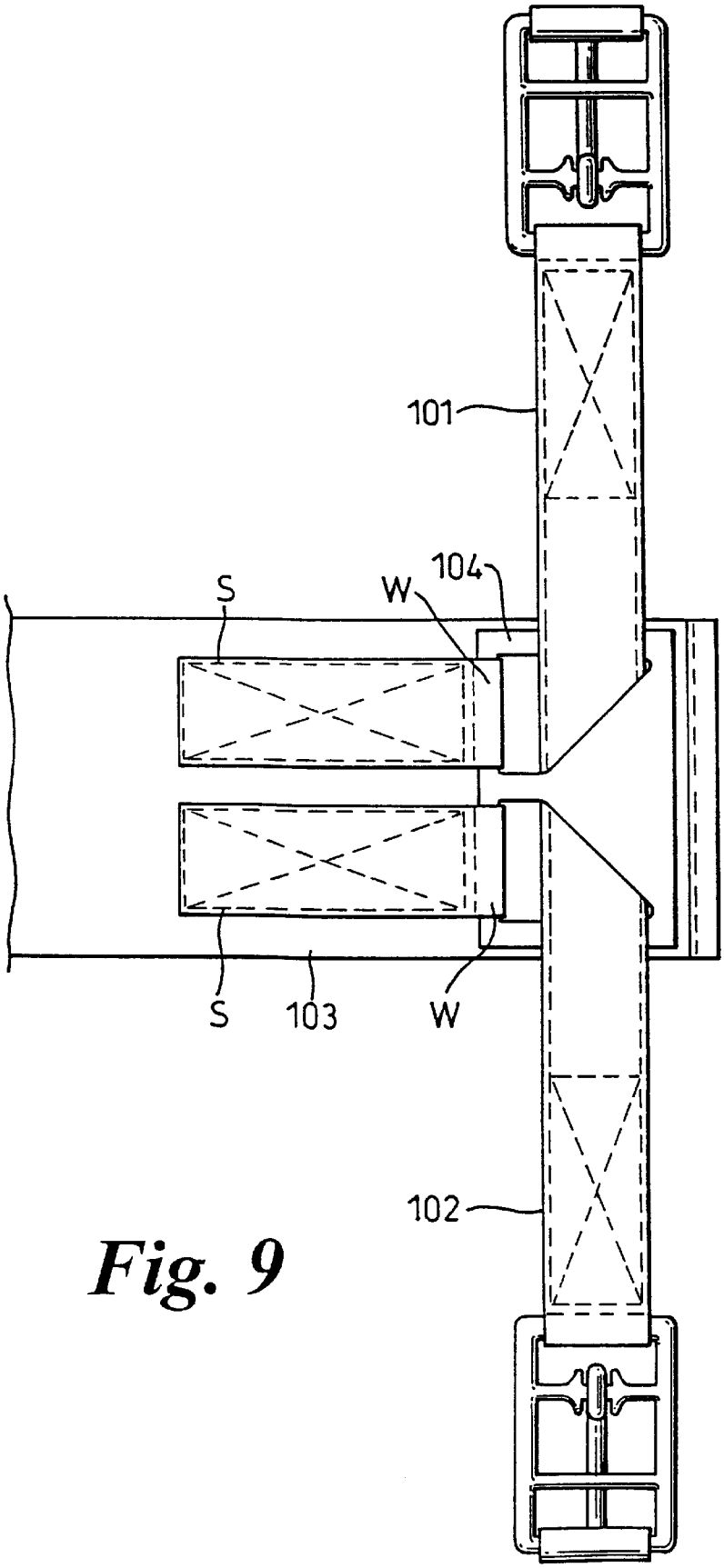
FIG. 9 shows an end of the girth strap similar to FIG. 8 but with the billet strap threaded through said fitting/component prior to being folded in place as in FIG. 8.

For ease of understanding, FIG. 9 shows how the billet strap 101,102 can be threaded through the fitting 104 at right angles to the main girth strap length 103 prior to folding to the position as shown in FIG. 8.

Figure 10:
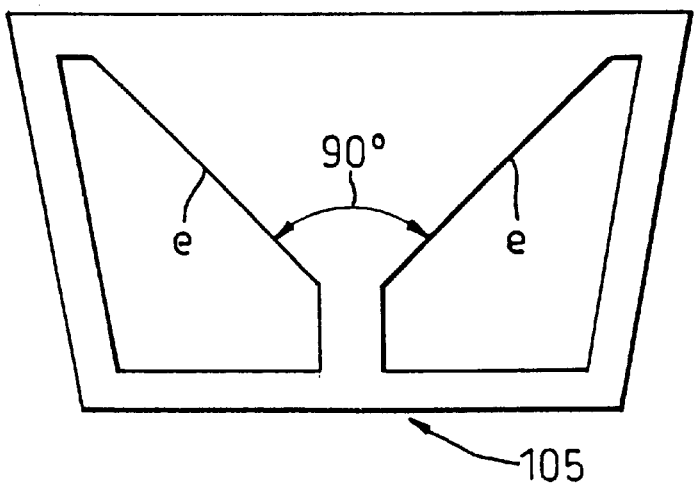
FIG. 10 shows a view similar to FIG. 7 but of a modified fitting/component.

The precise form of the fitting 104 can be varied to suit and could be modified to the shape of fitting/component 105 shown in FIG. 10. An important feature of the fitting/component 104,104',105 is that the inclined guide edges e of the similar, generally trapezoidal shaped openings O are inclined towards one another generally at 90° and generally at 45° to the axis of the main girth length in order to allow the ends of the buckle straps 101,102 to be folded about the fitting 104,104',105 to extend in a parallel relationship with one another.

The trapezoidal openings O are mirror images of one another about the axis of the main girth strap length. Each opening O has an edge $e_1$ opposing the guide edge e which aligns with the edge of the billet strap as it is threaded through the openings O and an edge $e_2$ extending along the axis of the main girth strap. The length of edge $e_2$ is slightly larger than the width of the billet strap. The bridge piece 104*a* is defined by shorter edges $e_3$ opposed to edges $e_2$. It is possible that the openings O could be more triangular with point $p_1$ being almost coincidental with point $p_2$. Component/fitting 104 has bar portions $b_1$, $b_2$ defined in part by edges $e_1$ around which webbing W is looped to attach the component/fitting to the main girth strap length by stitching S.

Advantageously, in this way it is an easy matter to replace the billet strap 101,102 with a new one if worn or the billet strap 101,102 can be removed easily for washing or even replaced with a different size (length) of billet strap 101,102 to be used with the same main girth length and thus may easily have the flexibility of use of the same main girth strap length with at least three different sizes of girth strap (to cater for different sizes of animal to which the girth strap is to be attached). The billet strap may be of elastic material.

Two popular girth webbing widths in use are 3",(75 mm) and 4",(102 mm) and the fitting 104,104',105 can be made of any suitable material for example, metal or plastics. The main girth length itself may be suitably shaped or contoured in known manner.

It is to be understood that the scope of the present invention is not to be unduly limited by the particular choice of terminology and that a specific term may be replaced or supplemented by any equivalent or generic term. For example, the term "buckled ends" could be replaced by "ends", "buckled portions", "buckled lengths", or "buckled sections"; "billet strap" could be replaced by "strap" or the like.

Further it is to be understood that individual features, method or functions relating to the girth strap or fitting/component or combination thereof might be individually patentably inventive. The singular may include the plural and vice versa. Additionally, any range mentioned herein for any variable or parameter shall be taken to include a disclosure of any derivable sub-range within that range or of any particular value of the variable or parameter arranged within, or at an end of, the range or sub-range.

What is claimed is:

1. In combination, a billet strap and a girth strap comprising a main girth strap length having at least one fitting or component at an associated end thereof for said billet strap, the billet strap being removably attached to said at least one fitting or component and folded so that free buckled ends of the billet strap extend parallel to one another along the axis of the main girth strap length.

2. The combination as claimed in claim 1 in which each end of the main girth strap length is provided with a fitting or component for an associated billet strap allowing said billet strap to be removably attached to the associated fitting or component and folded so the buckled ends can extend parallel to one another along said axis, wherein each pair of buckled ends extends in opposed directions.

3. The combination as claimed in claim 2, in which a billet strap can be threaded or passed through the associated fitting or component and each buckled end of the at least one billet strap can be folded about a respective guide edge of the fitting or component to lie parallel along the axis of the main girth length.

4. The combination as claimed in claim 3 in which said billet strap can be threaded or passed through the associated fitting or component generally at right angles to the main girth strap length.

5. The combination as claimed in claim 1 in which the at least one fitting or component is of rigid material.

6. The combination as claimed in claim 5 in which the fitting or component has two openings separated by a bridge piece.

7. A girth strap comprising a main girth strap length having at least one fitting or component at an associated end thereof for a billet strap, the arrangement being that the billet strap can be removably attached to said at least one fitting or component and folded so that free buckled ends of the billet strap can extend parallel to one another along the axis of the main girth strap length, said fitting or component being of rigid material and having two openings separated by a bridge piece in which the bridge piece extends axially of the main girth strap length.

8. A girth strap as claimed in claim 7 in which each of the two openings is similar, being a mirror image of the other about the longitudinal axis of the main girth strap length.

9. A girth strap comprising a main girth strap length having at least one fitting or component at an associated end thereof for a billet strap, the arrangement being that the billet strap can be removably attached to said at least one fitting or component and folded so that free buckled ends of the billet strap can extend parallel to one another alone the axis of the main girth strap length, and wherein the billet strap can be threaded or passed through the associated fitting or component and each buckled end of the billet strap can be folded about a respective guide edge of the fitting or component to lie parallel along the axis of the main girth length, said fitting or component being of rigid material and having two openings separated by a bridge piece, in which a guide edge is provided by an inclined edge of one of the two openings and another guide edge is provided by an inclined edge of the other one of the two openings.

10. A girth strap as claimed in claim 9 in which the inclined guide edges extend at right angles ±10° to one another.

11. A girth strap as claimed in claim 9 in which the inclined edges extend at 45°±5° to the longitudinal axis of the main girth strap length sloping away from the associated end of the main girth strap length towards the axis of said main girth length.

12. A girth strap as claimed in claim 9 in which a second edge of each opening opposing said guide edge extends transverse of the main girth strap length.

13. A girth strap as claimed in claim 12, wherein said fitting or component is of generally rectangular form secured to the girth strap length by loops of webbing and provides innermost transverse bar portions that can be secured to the main girth strap length by said loops of webbing stitched to said main girth strap length.

14. A girth strap as claimed in claim 13 in which the transverse bar portions are defined in part by said second edges of said openings opposed to said guide edges.

15. In combination with a girth strap comprising a main girth strap length including a billet strap at an end thereof, a fitting or component comprising two openings, said fitting or component being provided with means for attachment to said main girth strap length of said girth strap, the arrangement being such that the billet strap is threaded through the fitting or component through said openings in a direction generally at right angles to said main girth strap length and is folded twice relative thereto about a guide edge on each opening to removably attach the billet strap to the fitting or component with buckled ends of the billet strap extending parallel to one another along the axis of the main girth strap length.

16. A girth strap comprising the following features:

(a) a fitting or component allowing a billet strap to be threaded therethrough generally at right angles to a main girth strap length, (b) a component or fitting having guide edges on respective openings extending generally at 90°±10° thereto and generally at 45°±5° to the axis of the girth strap, (c) a billet strap removably attached to a fitting or component attached by webbing to a main girth strap length, (d) at least one generally rectangular fitting or component for a billet strap located at an associated end of a main girth strap length, said fitting or component including two similar openings being mirror images of one another about the axis of the main girth strap length, and (e) a fitting or component having a guide edge for guiding the direction on which an end of a billet strap will lie.

17. A girth strap according to claim 16, wherein said billet strap further comprises buckled ends wherein said buckled ends can be folded to extend parallel with the axis of the main girth strap length.

18. The combination of claim 15, wherein said means for attachment comprises loops of webbing stitched to said main girth strap length.

* * * * *